US011441471B2

(12) United States Patent
Sadamitsu

(10) Patent No.: US 11,441,471 B2
(45) Date of Patent: Sep. 13, 2022

(54) EXHAUST PURIFYING APPARATUS AND METHOD FOR CONTROLLING EXHAUST PURIFYING APPARATUS

(71) Applicant: TOYOTA JIDOSHA KABUSHIKI KAISHA, Aichi-ken (JP)

(72) Inventor: Takahiro Sadamitsu, Miyoshi (JP)

(73) Assignee: TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 17/319,091

(22) Filed: May 13, 2021

(65) Prior Publication Data

US 2021/0363908 A1 Nov. 25, 2021

(30) Foreign Application Priority Data

May 19, 2020 (JP) ..... JP2020-087448

(51) Int. Cl.

| | |
|---|---|
| ***F01N 3/00*** | (2006.01) |
| ***F01N 9/00*** | (2006.01) |
| ***F01N 3/027*** | (2006.01) |
| ***F01N 3/035*** | (2006.01) |

(52) U.S. Cl.

CPC ..... *F01N 9/002* (2013.01); *F01N 3/027* (2013.01); *F01N 3/035* (2013.01); *F01N 2240/16* (2013.01); *F01N 2250/02* (2013.01); *F01N 2260/04* (2013.01); *F01N 2390/02* (2013.01); *F01N 2900/0602* (2013.01); *F01N 2900/08* (2013.01)

(58) Field of Classification Search

CPC ..... F01N 9/002; F01N 3/027; F01N 3/035; F01N 2240/16; F01N 2250/02; F01N 2260/04; F01N 2390/02; F01N 2900/0602; F01N 2900/08

See application file for complete search history.

(56) References Cited

U.S. PATENT DOCUMENTS

| | | | | |
|---|---|---|---|---|
| 4,811,559 | A * | 3/1989 | Henkel | F01N 3/027 60/303 |
| 5,243,819 | A * | 9/1993 | Woerner | F01N 3/031 60/299 |
| 5,853,437 | A * | 12/1998 | Peter | F01N 3/027 55/525 |
| 2005/0217252 | A1* | 10/2005 | Sato | F01N 3/0253 60/297 |
| 2009/0090089 | A1* | 4/2009 | Phelps | B01D 46/2451 427/372.2 |

(Continued)

FOREIGN PATENT DOCUMENTS

| | | | |
|---|---|---|---|
| JP | 2010144630 | A | 7/2010 |
| JP | 201853782 | A | 4/2018 |

*Primary Examiner* — Matthew T Largi
(74) *Attorney, Agent, or Firm* — Hauptman Ham, LLP

(57) ABSTRACT

A controller controls energization of a filter and a fuel addition valve in an exhaust purifying apparatus. The controller executes a filter regeneration process when an electrical resistance value between two electrodes fixed to an outer surface of the filter is less than a predetermined regeneration determination value. The controller executes a soot burning process when the electrical resistance value is greater than or equal to the regeneration determination value and less than a soot burning determination value, which is set in advance to be larger than the regeneration determination value.

6 Claims, 3 Drawing Sheets

(56) References Cited

U.S. PATENT DOCUMENTS

| | | | | |
|---|---|---|---|---|
| 2010/0018190 | A1* | 1/2010 | Harada | B01D 53/944 60/286 |
| 2011/0067386 | A1* | 3/2011 | Gonze | F01N 3/0231 60/303 |
| 2012/0011834 | A1* | 1/2012 | Sobue | F01N 3/2013 422/174 |
| 2012/0291628 | A1* | 11/2012 | Seo | F01N 9/002 95/18 |
| 2018/0087427 | A1 | 3/2018 | Korenaga | |
| 2020/0309002 | A1* | 10/2020 | Miyairi | F01N 3/035 |

* cited by examiner

EXHAUST PURIFYING APPARATUS AND METHOD FOR CONTROLLING EXHAUST PURIFYING APPARATUS

RELATED APPLICATIONS

The present application claims priority of Japanese Application Number 2020-087448, filed on May 19, 2020, the disclosure of which is hereby incorporated by reference herein in its entirety.

BACKGROUND

1. Field

The present disclosure relates to an exhaust purifying apparatus including a filter device that traps particulate matter in exhaust gas of an internal combustion engine and to a method for controlling an exhaust purifying apparatus.

2. Description of Related Art

Japanese Laid-Open Patent Publication No. 2018-53782 discloses a known exhaust purifying apparatus for an internal combustion engine. The exhaust purifying apparatus disclosed in this document includes an electrically heated catalytic device. The electrically heated catalytic device includes a catalytic support and two electrodes. The catalytic support is provided in an exhaust pipe and made of an electrically conductive material. The two electrodes are fixed to the outer surface of the catalytic support. The exhaust purifying apparatus of this document estimates, from the electrical resistance value between the electrodes, the amount of soot deposited in a gap portion between the catalytic support and the exhaust pipe. When the estimated amount of the deposited soot exceeds a certain amount, the exhaust purifying apparatus executes a soot burning process. The soot burning process heats the catalytic support to the temperature necessary for burning soot and eliminates the soot deposited in the gap portion between the catalytic support and the exhaust pipe.

Some exhaust purifying apparatuses include a filter device that traps particulate matter in exhaust gas. The filter device includes a particulate matter trapping filter arranged in the exhaust pipe. The size of particulate matter is on the order of micrometer among the soot contained in exhaust gas. The filter traps soot having a larger size than particulate matter.

When a vast amount of soot deposits in the filter, the filter's performance of trapping particulate matter decreases. Thus, before the particulate matter trapping performance decreases, the exhaust purifying apparatus including the filter executes a filter regeneration process that eliminates the soot deposited in the filter. Such an exhaust purifying apparatus also executes a soot burning process that eliminates the soot adhering to the gap portion between the filter and the exhaust pipe.

SUMMARY

The present disclosure provides an exhaust purifying apparatus capable of efficiently executing a filter regeneration process for a filter device and a soot burning process.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

To solve the above-described problem, a first aspect of the present disclosure provides an exhaust purifying apparatus including a filter device. The filter device includes: a particulate matter trapping filter arranged in an exhaust pipe of an internal combustion engine, the filter being made of an electrically conductive material; and two electrodes fixed to an outer surface of the filter. The exhaust purifying apparatus also includes a resistance value obtaining unit configured to obtain an electrical resistance value between the two electrodes; an energy supplying unit configured to supply energy converted into heat received by the filter; and a controller configured to execute a filter regeneration process and a soot burning process, the filter regeneration process eliminating soot deposited in the filter with the energy supplied by the energy supplying unit, the soot burning process eliminating soot deposited in a gap portion between the filter and the exhaust pipe with the energy supplied by the energy supplying unit. A total amount of the energy supplied by the energy supplying unit during the filter regeneration process is larger than a total amount of the energy supplied by the energy supplying unit during the soot burning process. The controller is configured to execute the filter regeneration process when the electrical resistance value obtained by the resistance value obtaining unit is less than a predetermined first determination value and execute the soot burning process when the electrical resistance value is greater than or equal to the first determination value and less than a second determination value that has been set in advance to be larger than the first determination value.

To solve the above-described problem, a second aspect of the present disclosure provides an exhaust purifying apparatus includes a filter device. The filter device includes: a particulate matter trapping filter arranged in an exhaust pipe of an internal combustion engine, the filter being made of an electrically conductive material; and two electrodes fixed to an outer surface of the filter. The exhaust purifying apparatus also includes a resistance value obtaining unit configured to obtain an electrical resistance value between the two electrodes; an energy supplying unit configured to supply energy converted into heat received by the filter; and a controller configured to execute a filter regeneration process and a soot burning process, the filter regeneration process eliminating soot deposited in the filter with the energy supplied by the energy supplying unit, the soot burning process eliminating soot deposited in a gap portion between the filter and the exhaust pipe with the energy supplied by the energy supplying unit. A total amount of the energy supplied by the energy supplying unit during the filter regeneration process is larger than a total amount of the energy supplied by the energy supplying unit during the soot burning process. The controller includes circuitry configured to execute the filter regeneration process when the electrical resistance value obtained by the resistance value obtaining unit is less than a predetermined first determination value and execute the soot burning process when the electrical resistance value is greater than or equal to the first determination value and less than a second determination value that has been set in advance to be larger than the first determination value.

To solve the above-described problem, a third aspect of the present disclosure provides a method for controlling an exhaust purifying apparatus that includes a filter device. The filter device includes: a particulate matter trapping filter arranged in an exhaust pipe of an internal combustion engine, the filter being made of an electrically conductive material; and two electrodes fixed to an outer surface of the filter. The exhaust purifying apparatus also includes: a resistance value obtaining unit configured to obtain an electrical resistance value between the two electrodes; an energy supplying unit configured to supply energy converted into heat received by the filter; and a controller configured to execute a filter regeneration process and a soot burning process, the filter regeneration process eliminating soot deposited in the filter with the energy supplied by the energy supplying unit, the soot burning process eliminating soot deposited in a gap portion between the filter and the exhaust pipe with the energy supplied by the energy supplying unit. A total amount of the energy supplied by the energy supplying unit during the filter regeneration process is larger than a total amount of the energy supplied by the energy supplying unit during the soot burning process. The method includes, by the controller, executing the filter regeneration process when the electrical resistance value obtained by the resistance value obtaining unit is less than a predetermined first determination value and executing the soot burning process when the electrical resistance value is greater than or equal to the first determination value and less than a second determination value that has been set in advance to be larger than the first determination value.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

An exhaust purifying apparatus according to an embodiment will now be described in detail with reference to FIGS. 1 to 3. The exhaust purifying apparatus of the present embodiment is employed in an internal combustion engine 10, which is mounted on a vehicle.

Figure 1:
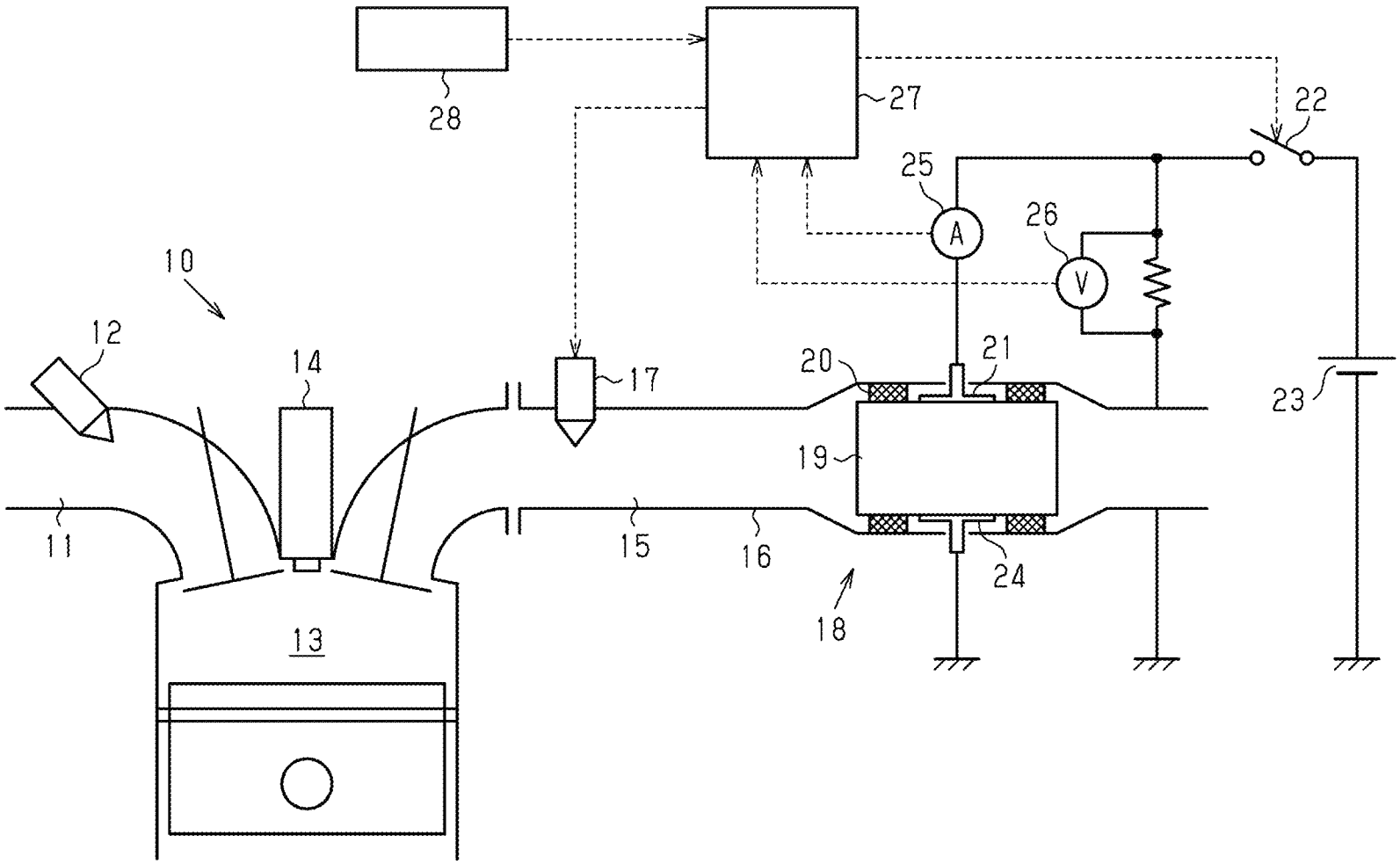
FIG. 1 is a schematic diagram showing the configuration of an exhaust purifying apparatus according to an embodiment.

As shown in FIG. 1, the internal combustion engine 10 includes an intake passage 11. The intake passage 11 is provided with an injector 12, which injects fuel into the intake air flowing through the intake passage 11. The internal combustion engine 10 includes a combustion chamber 13. The combustion chamber 13 is provided with an ignition device 14, which ignites, with spark discharge, air-fuel mixture drawn in through the intake passage 11. The internal combustion engine 10 includes an exhaust passage 15, which includes an exhaust pipe 16. The exhaust pipe 16 is made of an electrically conductive material, such as stainless steel. The exhaust pipe 16 is electrically grounded to the vehicle body.

The exhaust purifying apparatus includes a fuel adding valve 17. The fuel adding valve 17 is arranged on the exhaust pipe 16 to inject fuel into the exhaust gas flowing through the exhaust pipe 16. The exhaust purifying apparatus further includes a filter device 18. The filter device 18 is arranged in the exhaust pipe 16 on the downstream side of the fuel adding valve 17.

The filter device 18 includes a particulate matter trapping filter 19, which is arranged in the exhaust pipe 16. The filter 19 is made of an electrically-conductive porous material, such as silicon carbide. The filter 19 supports a catalyst used for purifying exhaust gas. The catalyst supported by the filter 19 is a three-way catalyst made of, for example, platinum or palladium. The three-way catalyst oxidizes carbon monoxide and hydrocarbon, which are unburned fuel components in exhaust gas, and at the same time reduces nitrogen oxide in exhaust gas. The three-way catalyst also functions as an oxidation catalyst that expedites oxidation of unburned fuel in exhaust gas. The filter device 18 includes an insulating spacer 20, which is arranged between the filter 19 and the exhaust pipe 16. The filter 19 is insulated from the exhaust pipe 16 by the spacer 20. The filter device 18 includes two electrodes, namely, a high potential side electrode 21 and a ground side electrode 24. The electrodes 21, 24 are fixed to the outer surface of the filter 19. The high potential side electrode 21 is connected to a high potential side terminal of a power supply 23 via a switch 22. The ground side electrode 24 is electrically grounded to the vehicle body. The filter device 18 includes an electric circuit through which current flows between the electrodes 21, 24. This electric circuit includes an ammeter 25 and a voltmeter 26. The ammeter 25 detects a filter current value If, which is the value of current flowing through the filter 19 and then flowing between the electrodes 21, 24. The voltmeter 26 detects an insulation potential difference Ei, which is the potential difference between the high potential side section of the electric circuit and the exhaust pipe 16.

The exhaust purifying apparatus further includes a controller 27, which controls the exhaust purifying apparatus. The controller 27 includes a calculation processing circuit, which executes a calculation process to control the exhaust purifying apparatus, and a storage circuit, which stores programs and data for control. The controller 27 receives the filter current value If measured by the ammeter 25 and the insulation potential difference Ei measured by the voltmeter 26. The controller 27 also receives the information related to a load KL on the internal combustion engine 10 from an engine control unit 28, which is an electronic control unit that controls the internal combustion engine 10. In the control of the exhaust purifying apparatus by the controller 27, the received information is used by the calculation processing circuit to execute the programs read from the storage circuit, and then the execution result is used to operate the fuel adding valve 17 and the switch 22.

The filter 19 uses the supported catalyst to purify unburned fuel components and nitrogen oxide in exhaust gas Immediately after the internal combustion engine 10 is started, the filter device 18 is unable to sufficiently purify exhaust gas because the temperature of the filter 19 is low and the catalyst is deactivated. When low-load and no-load operation of the internal combustion engine 10 is performed, the temperature of exhaust gas decreases. This may lower the temperature of the filter 19 so that the activation of the catalyst may not be able to be maintained. To cope with such a problem, immediately after the internal combustion engine 10 is started and when the low-load and no-load operation of the internal combustion engine 10 is performed, the controller 27 turns on the switch 22 to cause current to flow into the filter 19. In response to the energization, the filter 19 generates heat that increases the temperature of the filter 19 and activates the catalyst.

The filter 19 also traps soot containing particulate matter in exhaust gas. The filter 19 is capable of trapping a limited amount of soot. Thus, when the amount of soot deposited in the filter 19 approaches a limit, the particulate matter trapping performance of the filter 19 decreases. In addition, the soot in exhaust gas enters a gap portion between the filter 19 and the exhaust pipe 16 and deposits in the gap portion. When a vast amount of soot deposits in the gap portion, current flows through the deposited soot from the filter 19 to the exhaust pipe 16. This may lower the insulation resistance between the filter 19 and the exhaust pipe 16. To cope with such a problem, the controller 27 executes a filter regeneration process and a soot burning process when necessary. The filter regeneration process eliminates the soot deposited in the filter 19. The soot burning process eliminates the soot deposited in the gap portion between the filter 19 and the exhaust pipe 16.

Figure 2:
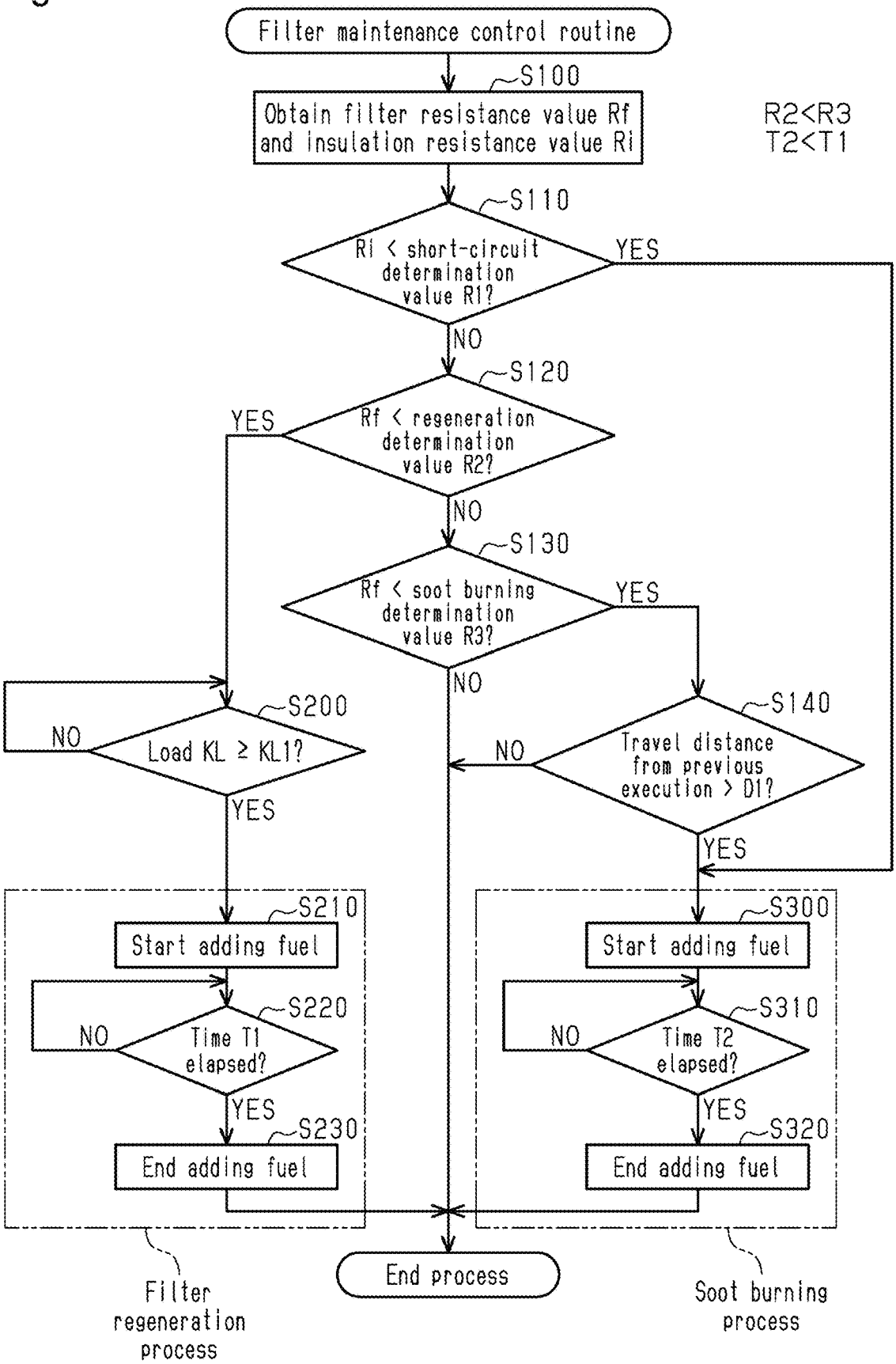
FIG. 2 is a flowchart illustrating a filter maintenance control routine executed by the controller for the exhaust purifying apparatus.
Figure 3:
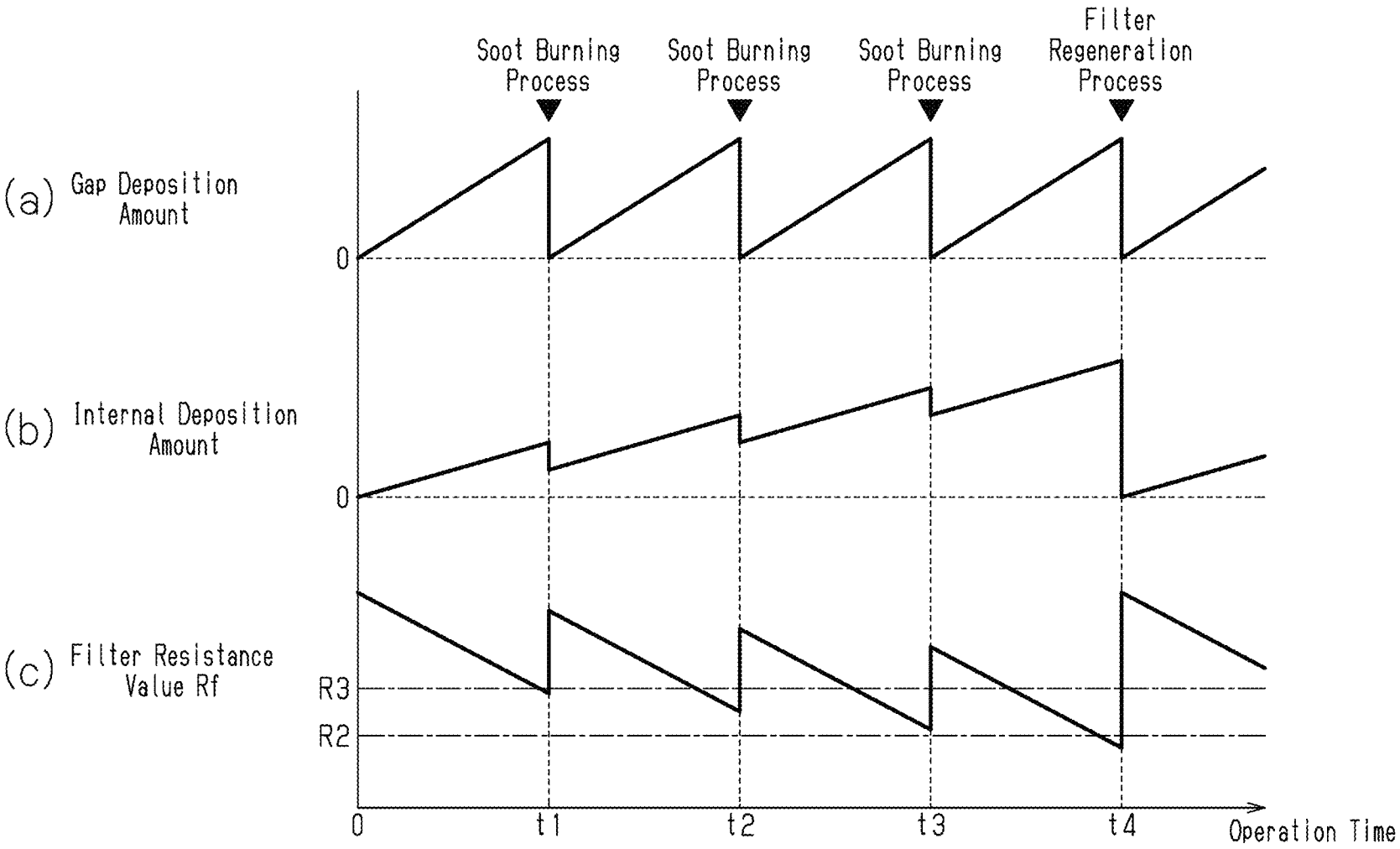
FIG. 3 is a timing diagram illustrating the relationship of the soot burning process and the filter regeneration process executed by the exhaust purifying apparatus with the timings of executing the soot burning process and the filter regeneration process, in which section (a) shows changes in a gap deposition amount, section (b) shows changes in an internal deposition amount, and section (c) shows changes in the filter resistance value.

FIG. 2 shows a flowchart illustrating a filter maintenance control routine executed by the controller 27 for the filter regeneration process and the soot burning process. The controller 27 starts the process of this routine, at the same time as starting the energizing of the filter 19 immediately after starting the internal combustion engine 10 and during the low-load and no-load operation of the internal combustion engine 10.

When the process of this routine is started, a filter resistance value Rf and an insulation resistance value Ri are first obtained in step S100. The filter resistance value Rf is the electrical resistance value of the filter 19. The insulation resistance value Ri is the electrical resistance value between the exhaust pipe 16 and the high potential side section of the electric circuit in the filter device 18. The filter resistance value Rf obtained in this step is calculated by the controller 27 from the current value measured by the ammeter 25 and the output voltage of the power supply 23. The insulation resistance value Ri obtained in this step is calculated by the controller 27 from the insulation potential difference Ei measured by the voltmeter 26. In the present embodiment, the ammeter 25, which measures the filter current value If, and the controller 27, which calculates the filter resistance value Rf from the filter current value If, correspond to a resistance value obtaining unit. The resistance value obtaining unit obtains the electrical resistance value between the two electrodes 21, 24 of the filter device 18.

Subsequently, it is determined in step S110 whether the insulation resistance value Ri is less than a predetermined short-circuit determination value R1. When the insulation resistance value Ri is less than the short-circuit determination value R1 (step S110: YES), the process is advanced to step S300. When the insulation resistance value Ri is greater than or equal to the short-circuit determination value R1 (step S110: NO), the process is advanced to step S120. The short-circuit determination value R1 is set to be smaller than the lower limit value of a tolerance range of the insulation resistance value Ri in a state of the filter device 18 immediately after being manufactured. The determination in step S110 is made in order to check whether the insulation resistance between the filter 19 and the exhaust pipe 16 has decreased.

When a decrease in the insulation resistance between the filter 19 and the exhaust pipe 16 is not detected, the process is advanced to S120. In step S120, it is determined whether the filter resistance value Rf is less than a predetermined regeneration determination value R2. When the filter resistance value Rf is less than the regeneration determination value R2 (step S120: YES), the process is advanced to step S200. When the filter resistance value Rf is greater than or equal to the regeneration determination value R2 (step S120: NO), the process is advanced to step S130. The regeneration determination value R2 is set to the filter resistance value Rf used when the amount of soot deposited in the filter 19 is increased to such an extent that the filter regeneration process needs to be executed.

When the process is advanced to step S130, it is determined in step S130 whether the filter resistance value Rf is less than a predetermined soot burning determination value R3. When the filter resistance value Rf is less than the soot burning determination value R3 (step S130: YES), the process is advanced to step S140. When the filter resistance value Rf is greater than or equal to the soot burning determination value R3 (step S130: NO), the current process is ended. The soot burning determination value R3 is set to the filter resistance value Rf used when the amount of soot deposited in the gap portion between the filter 19 and the exhaust pipe 16 is increased to such an extent that the soot burning process needs to be executed. As described below, the soot burning determination value R3 is larger than the regeneration determination value R2.

When the filter resistance value Rf is less than the soot burning determination value R3, the process is advanced to step S140. In step S140, it is determined whether the travel distance of the vehicle from when the previous soot burning process was executed is greater than a predetermined soot burning suspension distance D1. The soot burning suspension distance D1 is set to the minimum value of a hypothetical range of the travel distance of the vehicle necessary for a state in which no soot is deposited in the gap portion between the filter 19 and the exhaust pipe 16 to become a state in which soot having an amount that needs the execution of the soot burning process is deposited in the gap portion. When the travel distance is less than or equal to the soot burning suspension distance D1 (step S140: NO), the process of the current routine is ended. When the travel distance is greater than the soot burning suspension distance D1 (step S140: YES), the process is advanced to step S300. In step S300, the soot burning process is started.

When the filter resistance value Rf is determined as being less than the regeneration determination value R2 in step S120, the process is advanced to step S200. In step S200, the advancement to the next process is delayed until the load KL on the internal combustion engine 10 becomes greater than or equal to a predetermined regeneration executing determination value KL1. When the load KL on the internal combustion engine 10 becomes greater than or equal to the regeneration executing determination value KL1, the process is advanced to step S210. In step S210, the filter regeneration process is started.

When the filter regeneration process is started, the fuel adding valve 17 first starts adding fuel into exhaust gas in step S210. The addition of fuel to exhaust gas in the filter regeneration process is performed by the fuel adding valve 17 intermittently repeating the fuel injection. The fuel injected by the fuel adding valve 17 flows into the filter 19 together with the exhaust gas. The fuel is then oxidized by the action of the catalyst supported by the filter 19. The oxidization generates heat that increases the temperature of the filter 19. The cycles of fuel injection by the fuel adding valve 17 in the filter regeneration process and the amount of fuel injected by the fuel adding valve 17 in each cycle are set so as to keep the temperature of the filter 19 that has been increased to a temperature necessary for the burning and purification of the soot deposited in the filter 19. The fuel addition is continued until the elapse of time T1, which is necessary for the soot deposited in the filter 19 to be eliminated completely. When the time T1 has elapsed from the beginning of the fuel addition (step S220: YES), the fuel addition is ended to end the filter regeneration process in step S230. Then, the process of the current routine is ended.

When the process is advanced to step S300 as a result of the determination in step S110 or step S140, the soot burning process is started. When the soot burning process is started, the fuel adding valve 17 first starts adding fuel into exhaust gas in step S300. In the same manner as the filter regeneration process, the addition of fuel to exhaust gas in the soot burning process is performed by the fuel adding valve 17 intermittently repeating the fuel injection. The cycles of fuel injection by the fuel adding valve 17 in the soot burning process and the amount of fuel injected by the fuel adding valve 17 in each cycle are set so as to keep the temperature of the filter 19 that has been increased to a temperature necessary for the burning and purification of the soot deposited in the gap portion between the filter 19 and the exhaust pipe 16. The fuel addition is continued until the elapse of time T2, which is necessary for the soot deposited in the gap portion between the filter 19 and the exhaust pipe 16 to be eliminated completely. When the time T2 has elapsed from the beginning of the fuel addition (step S310: YES), the fuel addition is ended to end the soot burning process in step S320. Then, the process of the current routine is ended. As described below, the time T2, during which fuel is added in the soot burning process, is shorter than the time T1, during which fuel is added in the filter regeneration process. In other words, the execution time of the filter regeneration process is longer than the execution time of the soot burning process.

The operation and advantages of the present embodiment will now be described.

When soot, which is electrically conductive, deposits in the filter 19 and in the gap portion between the filter 19 and the exhaust pipe 16, a decrease occurs in the filter resistance value Rf, which is the electrical resistance value between the electrodes 21, 24 of the filter device 18. The filter 19 is designed such that its particulate matter trapping performance is maintained even if a relatively large amount of soot deposits in the filter 19. However, the insulation resistance between the filter 19 and the exhaust pipe 16 decreases if just one electrically conductive path is formed by soot between the filter 19 and the exhaust pipe 16. Thus, the insulation resistance between the filter 19 and the exhaust pipe 16 is likely to decrease if even a smaller amount of soot than the amount of soot deposited in the filter 19 that would lower the particulate matter trapping performance deposits in the gap portion between the filter 19 and the exhaust pipe 16. Accordingly, the filter resistance value Rf obtained when soot is deposited in the gap portion between the filter 19 and the exhaust pipe 16 to such an extent that the insulation resistance would decrease is larger than the filter resistance value Rf obtained when soot is deposited in the filter 19 to such an extent that the particulate matter trapping performance decreases. To solve this problem, the controller 27 executes the filter regeneration process, which eliminates the soot deposited in the filter 19, when the filter resistance value Rf is less than the regeneration determination value R2, and the controller 27 executes the soot burning process when the filter resistance value Rf is less than the soot burning determination value R3 and greater than or equal to the regeneration determination value R2.

Even if a small amount of soot is deposited in the gap portion between the filter 19 and the exhaust pipe 16, the insulation resistance between the filter 19 and the exhaust pipe 16 may decrease depending on where the deposition occurs. Thus, in the present embodiment, the insulation resistance value Ri between the filter 19 and the exhaust pipe 16 is obtained from the measurement result of the insulation potential difference Ei between the high potential side section of the electric circuit in the filter device 18 and the exhaust pipe 16. When a decrease in the insulation resistance value Ri is observed, the soot burning process is executed even if the filter resistance value Rf is greater than or equal to the soot burning determination value R3.

In the exhaust purifying apparatus of the present embodiment, the filter regeneration process and the soot burning process are both performed by the fuel adding valve 17 intermittently injecting fuel into exhaust gas. The fuel injected by the fuel adding valve 17 in these processes is converted into the heat received by the filter 19 through oxidization in the filter 19. That is, the fuel injected by the fuel adding valve 17 into exhaust gas in these processes corresponds to the energy that is converted into the heat received by the filter 19. In the present embodiment, the fuel adding valve 17, which injects fuel into exhaust gas, corresponds to an energy supplying unit that supplies energy.

The soot subject to being eliminated in the soot burning process is deposited on the outer surface of the filter 19 and the inner wall surface of the exhaust pipe 16. In contrast, the soot subject to being eliminated in the filter regeneration process is deposited in complicated pores in the filter 19, which is made of a porous material, and is harder to eliminate than the soot subject to being eliminated in the soot burning process. Thus, the filter regeneration process needs to keep the filter 19 at a high temperature during a longer period than the soot burning process. Accordingly, the execution of the filter regeneration process consumes a larger amount of fuel than the execution of the soot burning process. In other words, the total amount of the fuel (energy) supplied by the fuel adding valve 17 (energy supplying unit) during the filter regeneration process is larger than the total amount of the fuel (energy) supplied by the fuel adding valve 17 (energy supplying unit) during the soot burning process. In the present embodiment, the filter regeneration process, which consumes a larger amount of fuel than the soot burning process, is executed on condition that the load KL on the internal combustion engine 10 is greater than or equal to the regeneration executing determination value KL1. As the load KL on the internal combustion engine 10 increases, the temperature of exhaust gas increases and the temperature of the filter 19 increases accordingly. Thus, when the filter regeneration process is performed with a high load KL on the internal combustion engine 10, a smaller amount of fuel is needed to keep the filter 19 at a temperature necessary for the elimination of soot. This lowers the consumption of fuel in the filter regeneration process in the present embodiment. Basically, the soot burning process consumes a small amount of fuel. Thus, even if the soot burning process is executed on condition that the load KL is high, the fuel consumption amount is reduced in a limited manner. To cope with this problem, in the present embodiment, the soot burning process is executed regardless of the load KL on the internal combustion engine 10. Thus, the opportunity to execute the soot burning process is obtained easily.

The manner of executing the soot burning process and the filter regeneration process in the exhaust purifying apparatus of the present embodiment will now be described with reference to FIG. 3. Section (a) of FIG. 3 shows changes in a gap deposition amount, which is the amount of soot deposited in the gap portion between the filter 19 and the exhaust pipe 16. Section (b) of FIG. 3 shows changes in an internal deposition amount, which is the amount of soot deposited in the filter 19. Section (c) of FIG. 3 shows changes in the filter resistance value Rf. The horizontal axis of FIG. 3 represents the operation time of the internal combustion engine 10 from when the operation is started. The gap deposition amount and the internal deposition amount of the filter device 18 is 0 when the operation is started. FIG. 3 also shows the changes in the gap deposition amount and the internal deposition amount with respect to the operation time of the internal combustion engine 10 as soot deposits in the gap portion between the filter 19 and the exhaust pipe 16 and in the filter 19 at constant speeds.

After the operation of the internal combustion engine 10 is started, the gap deposition amount and the internal deposition amount increase and the filter resistance value Rf gradually decreases. At the point in time t1 in FIG. 3, when the filter resistance value Rf decreases to less than the soot burning determination value R3, the soot burning process is executed so that the gap deposition amount becomes 0. In the soot burning process, the soot deposited in the filter 19 is eliminated to a certain degree. Thus, the internal deposition amount is smaller after the execution of the soot burning process than before the execution of the soot burning process. Further, because of the elimination of soot, the filter resistance value Rf is higher after the execution of the soot burning process than before the execution of the soot burning process. However, the soot burning process does not completely eliminate the soot deposited in the filter 19. Thus, after the execution of the soot burning process, the internal deposition amount does not become 0 and the filter resistance value Rf becomes lower than the value obtained when the operation of the internal combustion engine 10 is started.

After the execution of the soot burning process at the point in time t1, the gap deposition amount and the internal deposition amount start to increase again. As these amounts increase, the filter resistance value Rf decreases. However, after the execution of the soot burning process at the point in time t1, the filter resistance value Rf is lower than the value obtained when the internal combustion engine 10 is started. Thus, at this time, the filter resistance value Rf becomes less than the soot burning determination value R3 before the gap deposition amount changes to such an extent that the soot burning process needs to be executed. To cope with this problem, in the present embodiment, until the travel distance of the vehicle from when the previous soot burning process was executed exceeds the soot burning suspension distance D1, the execution of the next soot burning process is suspended. This prevents the soot burning process from being executed unnecessarily frequently. In sections (a) to (c) of FIG. 3, at the point in time t2 and the point in time t3, the soot burning process is executed in a state where the filter resistance value Rf is less than the soot burning determination value R3 and the travel distance of the vehicle from when the previous soot burning process was executed is greater than the soot burning suspension distance D1. In the exhaust purifying apparatus of the present embodiment, when the energization between the filter 19 and the exhaust pipe 16 is detected, the soot burning process is executed immediately at that point in time regardless of the travel distance from when the previous soot burning process was executed.

The internal deposition amount obtained after the second soot burning process is executed at the point in time t2 is greater than the amount obtained after the first soot burning process is executed at the point in time t1. The internal deposition amount obtained after the third soot burning process is executed at the point in time t3 is greater than the amount obtained after the second soot burning process is executed. Thus, although the internal deposition amount temporarily decreases every time the soot burning process is executed, the internal deposition amount changes so as to show a tendency to increase in a long term. Also, although the filter resistance value Rf temporarily increases every time the soot burning process is executed, the filter resistance value Rf changes so as to show a tendency to decrease in a long term. At the point in time t4, when the filter resistance value Rf decreases to less than the regeneration determination value R2, the filter regeneration process is executed. After the filter regeneration process is executed, the internal deposition amount becomes 0. Further, the filter regeneration process keeps the filter 19 at a high temperature for a longer period of time than the soot burning process. Accordingly, after the filter regeneration process is executed, the gap deposition amount also becomes 0.

The exhaust purifying apparatus of the present embodiment has the following advantages.

(1) The energy supplied by the fuel adding valve 17 is converted into the heat received by the filter 19. Thus, the supply of energy by the fuel adding valve 17 heats the filter 19. Further, heating the filter 19 eliminates the soot deposited in the filter 19 and in the gap portion between the filter 19 and the exhaust pipe 16. Thus, with the energy supplied by the fuel adding valve 17, the exhaust purifying apparatus executes both the filter regeneration process, which eliminates the soot deposited in the filter 19, and the soot burning process, which eliminates the soot deposited in the gap portion between the filter 19 and the exhaust pipe 16. The soot deposited in the filter 19 is harder to remove than the soot deposited in the gap portion between the filter 19 and the exhaust pipe 16. Thus, the filter regeneration process requires a larger amount of energy than the soot burning process.

The filter regeneration process needs to be executed before the amount of soot deposited in the filter 19 changes to such an extent that its particulate matter trapping performance decreases. The soot burning process needs to be executed before the amount of soot deposited in the gap portion between the filter 19 and the exhaust pipe 16 changes to such an extent that the insulation resistance therebetween the filter 19 and the exhaust pipe 16 decreases. Since the filter regeneration process and the soot burning process both consume energy, it is desired that these processes be delayed until needed.

When soot, which is electrically conductive, deposits in the filter 19 and in the gap portion between the filter 19 and the exhaust pipe 16, the filter resistance value between the electrodes 21, 24 of the filter device 18 decreases. The insulation resistance between the filter 19 and the exhaust pipe 16 decreases if just one electrically conductive path is formed by the soot deposited between the filter 19 and the exhaust pipe 16. In contrast, the particulate matter trapping performance of the filter 19 does not decrease until soot deposits over a wide range in the filter 19. Accordingly, the electrical resistance value between the electrodes 21, 24 is lower when the soot having an amount that needs the filter regeneration process is deposited in the filter 19 than when the soot having an amount that needs the soot burning process is deposited in the gap portion the filter 19 and the exhaust pipe 16.

In the exhaust purifying apparatus of the present embodiment, the controller 27 executes the filter regeneration process when the electrical resistance value is lower than the electrical resistance in the case where the soot burning process is executed. This allows the soot burning process and the filter regeneration process to be executed efficiently. More specifically, when the filter resistance value Rf is less than the regeneration determination value R2, the controller 27 executes the filter regeneration process, which eliminates the soot deposited in the filter 19. When the filter resistance value Rf is less than the soot burning determination value R3, which has been set in advance to be larger than the regeneration determination value R2, and is greater than or equal to the regeneration determination value R2, the controller 27 executes the soot burning process, which eliminates the soot deposited in the gap portion between the filter 19 and the exhaust pipe 16. The soot burning process and the filter regeneration process are executed at suitable timings using the filter resistance value Rf that correlates with the amount of soot deposited in the filter 19 and in the gap portion between the filter 19 and the exhaust pipe 16.

(2) The filter regeneration process adds fuel to exhaust gas for a longer period of time than the soot burning process. This prevents the soot burning process from consuming fuel unnecessarily while executing the filter regeneration process so as to completely eliminate the soot in the filter 19, which is harder to eliminate than the soot deposited in the gap portion between the filter 19 and the exhaust pipe 16.

(3) The filter regeneration process is executed on condition that the load KL on the internal combustion engine 10 is greater than or equal to the regeneration executing determination value KL1. This reduces the consumption of fuel in the filter regeneration process, which needs the fuel addition for a longer time than the soot burning process.

(4) The soot burning process is executed on condition that the travel distance of the vehicle from when the previous soot burning process was executed is greater than the soot burning suspension distance D1. That is, the minimum execution interval of the soot burning process is set from the travel distance of the vehicle. This prevents the soot burning process from being unnecessarily executed due to a decrease in the filter resistance value Rf resulting from the progress of deposition of soot into the filter 19.

(5) When a decrease in the insulation resistance between the filter 19 and the exhaust pipe 16 is detected, the soot burning process is immediately executed at that point in time. Thus, the decrease in the insulation resistance between the filter 19 and the exhaust pipe 16 is eliminated quickly after the decrease is detected.

The present embodiment may be modified as follows. The present embodiment and the following modifications can be combined as long as they remain technically consistent with each other.

In the above-described embodiment, the minimum execution interval of the soot burning process is set from the travel distance of the vehicle. The minimum execution interval of the soot burning process may be set from another parameter that correlates with the gap deposition amount, such as the running time of the internal combustion engine 10, intake air amount, or fuel injection amount. Alternatively, the soot burning process may be executed constantly without setting the minimum execution interval when the filter resistance value Rf is less than the soot burning determination value R3.

In the above-described embodiment, the soot burning process is executed when the filter resistance value Rf is less than the soot burning determination value R3 and also when a decrease in the insulation resistance between the filter 19 and the exhaust pipe 16 is detected. If the exhaust purifying apparatus does not include a means for detecting the insulation resistance, the execution of the soot burning process in response to the detection of a decrease in the insulation resistance may be omitted.

In the above-described embodiment, the filter regeneration process is executed on condition that the load KL on the internal combustion engine 10 is greater than or equal to the regeneration executing determination value KL1. The soot burning process may also be executed on condition that the load KL is greater than or equal to a fixed value.

The condition that the load KL on the internal combustion engine 10 is greater than or equal to the regeneration executing determination value KL1 may be excluded from the conditions for executing the filter regeneration process. That is, when the filter resistance value Rf is less than the regeneration determination value R2, the filter regeneration process may be executed regardless of the load KL on the internal combustion engine 10.

In the above-described embodiment, the filter regeneration process and the soot burning process may be executed through the injection of fuel into exhaust gas by the fuel adding valve 17. Other methods may be used to execute the filter regeneration process and the soot burning process by heating the filter 19. For example, the filter 19 can be heated by continuing the fuel injection performed by the injector 12 with the spark discharge of the ignition device 14 stopped while the vehicle is coasting at a reduced speed, and by drawing the fuel, injected by the injector 12, into the filter 19 in an unburned state. In this case, the fuel injected by the injector 12 serves as the energy converted into the heat received by the filter 19, and the injector 12 corresponds to the energy supplying unit. Alternatively, the filter 19 may be heated by energizing the filter 19. In this case, the power supplied to the filter 19 serves as the energy converted into the heat received by the filter 19, and the electric circuit of the filter device 18 including the power supply 23 corresponds to the energy supplying unit. As another option, the filter 19 may be heated by delaying the timing at which the ignition device 14 ignites an air-fuel mixture so that the efficiency of burning the air-fuel mixture in the combustion chamber 13 decreases and the temperature of the exhaust gas increases. In this case, due to the decrease in the burning efficiency, a requested output of the internal combustion engine 10 is obtained and thus the amount of fuel burned in the combustion chamber 13 needs to be increased. The increased fuel corresponds to the energy converted into the heat received by the filter 19. In this case, the internal combustion engine 10 including the ignition device 14 and the injector 12 corresponds to the energy supplying unit. Additionally, the filter regeneration process and the soot burning process may be executed by combining two or more of these methods for heating the filter 19.

In the above-described embodiment, the filter device 18 is configured to purify unburned fuel components and nitrogen oxide as well as trap particulate matter with the filter 19 supporting the three-way catalyst. If nitrogen oxide is not purified in the filter device 18, the catalyst supported by the filter 19 may be an oxidation catalyst that does not function to reduce nitrogen oxide and only functions to expedite the oxidization of unburned fuel. If the filter device 18 only traps particulate matter and the heat generated through the oxidization of unburned fuel in the filter 19 is not utilized to heat the filter 19 in the filter regeneration process and the soot burning process, a structure in which the filter 19 does not support a catalyst may be employed.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

The invention claimed is:

1. An exhaust purifying apparatus comprising:

a filter device, the filter device including:

a particulate matter trapping filter arranged in an exhaust pipe of an internal combustion engine, the particulate matter trapping filter being made of an electrically conductive material; and two electrodes fixed to an outer surface of the particulate matter trapping filter;

a resistance value obtaining unit including a controller configured to obtain an electrical resistance value between the two electrodes;

an energy supplying unit configured to supply energy converted into heat received by the particulate matter trapping filter; and the controller further configured to execute a filter regeneration process and a soot burning process, the filter regeneration process eliminating soot deposited in the particulate matter trapping filter with the energy supplied by the energy supplying unit, the soot burning process eliminating soot deposited in a gap portion between the particulate matter trapping filter and the exhaust pipe with the energy supplied by the energy supplying unit, wherein a total amount of the energy supplied by the energy supplying unit during the filter regeneration process is larger than a total amount of the energy supplied by the energy supplying unit during the soot burning process, and the controller is configured to execute the filter regeneration process when the electrical resistance value obtained by the resistance value obtaining unit is less than a predetermined first determination value and execute the soot burning process when the electrical resistance value is greater than or equal to the predetermined first determination value and less than a second determination value that has been set in advance to be larger than the predetermined first determination value.

2. The exhaust purifying apparatus according to claim 1, wherein an execution time of the filter regeneration process is longer than an execution time of the soot burning process.

3. The exhaust purifying apparatus according to claim 1, wherein the filter regeneration process is executed on a condition that a load on the internal combustion engine is greater than or equal to a predetermined value.

4. The exhaust purifying apparatus according to claim 1, wherein the particulate matter trapping filter supports an oxidation catalyst that expedites oxidation of unburned fuel in exhaust gas, and the energy supplying unit is configured to supply, as the energy, unburned fuel added to the exhaust gas before flowing into the particulate matter trapping filter.

5. The exhaust purifying apparatus according to claim 1, wherein the controller is configured to execute the soot burning process when a decrease in an insulation resistance between the particulate matter trapping filter and the exhaust pipe is detected.

6. A method for controlling an exhaust purifying apparatus that includes a filter device, wherein the filter device includes:

a particulate matter trapping filter arranged in an exhaust pipe of an internal combustion engine, the particulate matter trapping filter being made of an electrically conductive material; and two electrodes fixed to an outer surface of the particulate matter trapping filter;

the method comprises:

obtaining an electrical resistance value between the two electrodes;

supplying energy converted into heat received by the particulate matter trapping filter; and executing a filter regeneration process and a soot burning process, the filter regeneration process eliminating soot deposited in the particulate matter trapping filter with the energy supplied, the soot burning process eliminating soot deposited in a gap portion between the particulate matter trapping filter and the exhaust pipe with the energy supplied, a total amount of the energy supplied during the filter regeneration process is larger than a total amount of the energy supplied during the soot burning process, and the method further comprises executing the filter regeneration process when the electrical resistance value between the two electrodes is less than a predetermined first determination value and executing the soot burning process when the electrical resistance value between the two electrodes is greater than or equal to the first determination value and less than a second determination value that has been set in advance to be larger than the first determination value.

* * * * *